US008062004B2

(12) United States Patent
Jung et al.

(10) Patent No.: US 8,062,004 B2
(45) Date of Patent: Nov. 22, 2011

(54) DISCHARGING NOISE SYSTEM OF A HERMETIC COMPRESSOR

(75) Inventors: Min-Kyu Jung, Changwon-si (KR); Dong-Woo Park, Busan (KR); Hun-Sik Lee, Gimhae-si (KR); Chul-Hun Nam, Changwon-si (KR); Ki-Seok Sung, Changwon-si (KR)

(73) Assignee: LG Electronics Inc., Seoul (KR)

( * ) Notice: Subject to any disclaimer, the term of this patent is extended or adjusted under 35 U.S.C. 154(b) by 571 days.

(21) Appl. No.: 12/227,286

(22) PCT Filed: Oct. 29, 2007

(86) PCT No.: PCT/KR2007/005356

§ 371 (c)(1),
(2), (4) Date: Nov. 13, 2008

(87) PCT Pub. No.: WO2008/078875

PCT Pub. Date: Jul. 3, 2008

(65) Prior Publication Data

US 2009/0232671 A1 Sep. 17, 2009

(30) Foreign Application Priority Data

Dec. 27, 2006 (KR) ..... 10-2006-0135350

(51) Int. Cl.
*F04B 39/00* (2006.01)

(52) U.S. Cl. ..... 417/312; 417/415

(58) Field of Classification Search ..... 417/312, 417/415; 187/403

See application file for complete search history.

(56) References Cited

U.S. PATENT DOCUMENTS

| | | | |
|---|---|---|---|
| 5,173,034 | A | 12/1992 | Riffe |
| 2002/0071774 | A1 | 6/2002 | Lee |
| 2003/0035739 | A1 | 2/2003 | Seo |

FOREIGN PATENT DOCUMENTS

| | | | |
|---|---|---|---|
| JP | 64-060783 | | 3/1989 |
| JP | 2003-065231 | | 3/2003 |
| KR | 10-2001-0054933 | A | 7/2001 |
| KR | 10-2002-0045741 | A | 6/2002 |

*Primary Examiner* — Vip Patel

(74) *Attorney, Agent, or Firm* — McKenna Long & Aldridge LLP

(57) ABSTRACT

The present invention relates to a discharging noise system of a hermetic compressor. The present invention includes a first discharging noise suppressor (39) provided at one side end of a cylinder block 35 to firstly reduce noise and pulsation of work fluid compressed in and discharged from a compressing chamber (37) formed to be bored through the cylinder block (35) in a fore and aft direction, a second discharging noise suppressor (39') provided at the other side end of the cylinder block (35) and communicating with the first discharging noise suppressor 39 to secondarily reduce noise and pulsation of the work fluid with noise and pulsation reduced by the first discharging noise suppressor (39), a connection pipe (43) for allowing the first and second discharging noise suppressors (39) and (39') to communicate with each other to form a channel for allowing the work fluid to move, the connection pipe (43) having a length longer than a shortest straight distance between the discharging noise suppressors (39 and 39'), and a discharging pipe (45) provided at the second discharging noise suppressor (39') to form a channel through which the work fluid is discharged to the outside. According to the present invention configured as above, the connection pipe is relatively long to reduce pulsation, thereby improving operating characteristics of the hermetic compressor, so that vibration generated by the pulsation is reduced to improve durability of the hermetic compressor.

2 Claims, 7 Drawing Sheets

RELATED ART

RELATED ART

DISCHARGING NOISE SYSTEM OF A HERMETIC COMPRESSOR

This application is a national stage entry of International Patent Application No. PCT/KR2007/005356 filed Oct. 29, 2007, and claims the benefit of Korean Application No. 10-2006-0135350 filed Dec. 27, 2006, which are hereby incorporated by reference for all purposes as if fully set forth herein.

TECHNICAL FIELD

The present invention relates to a hermetic compressor, and more particularly, to a discharging noise system of a hermetic compressor provided with a connection pipe for connecting discharging noise suppressors.

BACKGROUND ART

FIG. 1 shows an interior of a conventional compressor. Referring to the figure, the conventional compressor has a hermetic container 1 composed of an upper container 1*t* and a lower container 1*b*, and a frame 2 installed in the hermetic container 1. A stator 3 is fixed to the frame 2, and the frame 2 is supported in the hermetic container 1 by means of a spring 2S.

A crank shaft 5 is installed to penetrate a center of the frame 2. A rotor 4 is integrally installed to the crank shaft 5 to rotate together therewith by means of electromagnetic interaction with the stator 3.

An eccentric pin 5*b* is formed at an upper end of the crank shaft 5 to be eccentric from a rotation center of the crank shaft 5, and a balancing weight 5*c* is formed at an opposite side to the eccentric pin 5*b*. The crank shaft 5 is installed to penetrate the center of the frame 2, and the inner circumference of the frame 2 installed through the crank shaft 5 functions as a kind of bearing.

In addition, an oil passage 5*a* is formed in the crank shaft 5. Oil L provided in a bottom of the hermetic container 1 is guided through the oil passage 5*a* to be transferred to an upper portion of the frame 2 and then scattered. Also, a pumping mechanism 5*d* is installed to a lower end of the crank shaft 5 to pump the oil L and thus transfer it to the oil passage 5*a*.

Meanwhile, a cylinder block 6 having a compressing chamber 6' provided therein is formed integrally with the frame 2. Also, a piston 7 connected to the eccentric pin 5*b* of the crank shaft 5 through a connecting rod 8 is installed in the compressing chamber 6'. In addition, a valve assembly 9 is installed to a front end of the cylinder block 6 to control a coolant introduced into and discharged from the compressing chamber 6'. A head cover 10 is mounted on the valve assembly 9, and a suction noise suppressor 11 is installed to the head cover 10 to be connected to the valve assembly 9 so that the coolant is transferred to the compressing chamber 6'.

Reference numeral 12 designates a suction pipe for transferring the coolant into the hermetic container 1, and reference numeral 13 designates a discharging pipe for discharging the compressed coolant to the outside of the compressor.

Meanwhile, FIG. 2 shows another conventional frame. Referring to the figure, a cylinder block 23 is provided in a frame 20 that has various parts of the compressor. A compressing chamber 24 is formed to be bored through the cylinder block 23. A piston (not shown) linearly reciprocated by a crank shaft (not shown) is installed in the compressing chamber 24 to compress work fluid. A valve assembly (not shown) is installed together with a head cover (not shown) to the cylinder block 23 that corresponds to a front end of the compressing chamber 24, wherein a discharging chamber (not shown) is provided between the head cover and the valve assembly such that the work fluid compressed by the piston is temporarily collected in the discharging chamber.

First and second discharging noise suppressors 25 and 25' are provided at both sides of the cylinder block 23. The discharging noise suppressors 25 and 25' are to reduce noise and pulsation of the work fluid compressed in the compressing chamber 24. A noise chamber (not shown) is formed in each of the discharging noise suppressors 25 and 25' to reduce noise and pulsation while the work fluid stays in the noise chamber for a while.

Noise suppressor caps 26 are respectively installed to upper ends of the discharging noise suppressors 25 and 25' to shield the noise chambers. The work fluid compressed in the compressing chamber 24 is firstly transferred to the first discharging noise suppressor 25, and noise and pulsation are reduced while the work fluid flows from the first discharging noise suppressor 25 to the second noise suppressor 25'. To this end, a connection pipe 27 is used to allow the discharging noise suppressors 25 and 25' to communicate with each other through the noise compressor caps 26. Reference numeral 29 designates a discharging pipe for discharging the work fluid discharged from the second discharging noise suppressor 25' to the outside of the hermetic container.

However, the conventional hermetic compressor so configured has the following problems.

In general, the piston provided in the compressing chamber 24 linearly reciprocates to compress the work fluid introduced into the compressing chamber 24. The work fluid compressed by the piston is discharged to the outside of the compressing chamber 24 and then introduced into a discharging chamber communicating with the compressing chamber 24. The work fluid introduced into the discharging chamber is moved into the first discharging noise suppressor 25. At this time, the work fluid generates pulsation since it is periodically discharged to the outside of the compressing chamber 24 due to linear reciprocation of the piston.

Thus, the pulsation causes vibration of the connection pipe 27 that connects the first and second discharging noise suppressors 25 and 25'. The vibration applies repeated stress to connection points of the connection pipe 27, thereby resulting in fatigue failure. Thus, the work fluid may leak out through the connection points.

DISCLOSURE

Technical Problem

The present invention is conceived to solve the aforementioned problems in the prior art. An object of the present invention is to reduce pulsation generated in a connection pipe.

Technical Solution

According to an aspect of the present invention for achieving the objects, there is provided a discharging noise system of a hermetic compressor, comprising: a first discharging noise suppressor provided in a cylinder block to firstly reduce noise and pulsation of work fluid, the work fluid being compressed in a compressing chamber formed in the cylinder block and discharged therefrom; a second discharging noise suppressor communicating with the first discharging noise suppressor, the work fluid with noise and pulsation reduced by the first discharging noise suppressor being introduced into the second discharging noise suppressor, whereby noise and pulsation of the work fluid is secondarily reduced; a connection pipe for allowing the first and second discharging noise suppressors to communicate with each other to form a channel for allowing the work fluid to move, the connection pipe having a length 1.1 to 1.5 times as long as a shortest straight distance between the discharging noise suppressors; and a discharging pipe provided at the second discharging noise suppressor to form a channel for allowing the work fluid to be discharged to the outside.

The connection pipe may include a first inclined portion formed slantingly with respect to a straight distance between the first and second discharging noise suppressors, the first inclined portion having one end connected to the first discharging noise suppressor; and a second inclined portion formed to be slanted reversely with respect to the first inclined portion, the second inclined portion having one end connected to the first inclined portion and the other end connected to the second discharging noise suppressor.

Advantageous Effects

A connection pipe for connecting discharging noise suppressors in the present invention is formed relatively longer than the shortest straight distance between the discharging noise suppressors. As the connection pipe is longer, pulsation is reduced. Thus, operation characteristics of a hermetic compressor are improved. If the operation characteristics of the hermetic compressor are improved, vibration generated from the pulsation is also reduced. Thus, the decreased vibration reduces fatigue failure between the connection pipe and the discharging noise suppressors, thereby improving durability of the hermetic compressor.

EXPLANATION OF REFERENCE NUMERALS FOR MAJOR PORTIONS SHOWN IN DRAWINGS

Figure 1:
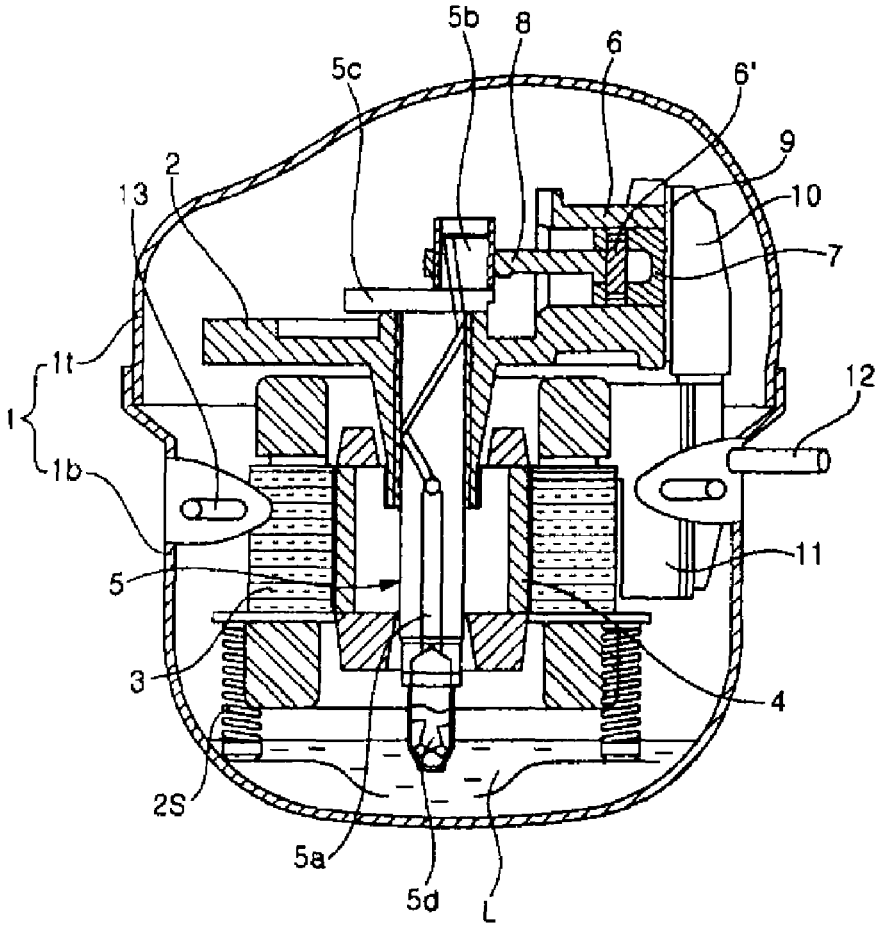
FIG. 1 is a sectional view showing an interior of a conventional hermetic compressor.
Figure 2:
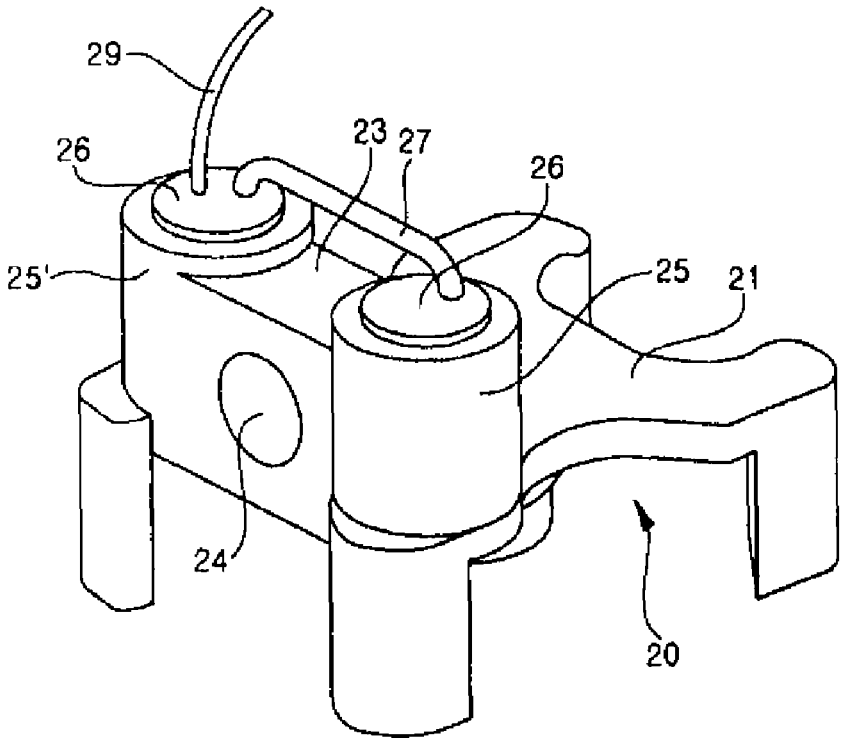
FIG. 2 is a perspective view showing an exterior of a conventional discharging noise system of a hermetic compressor.
Figure 3:
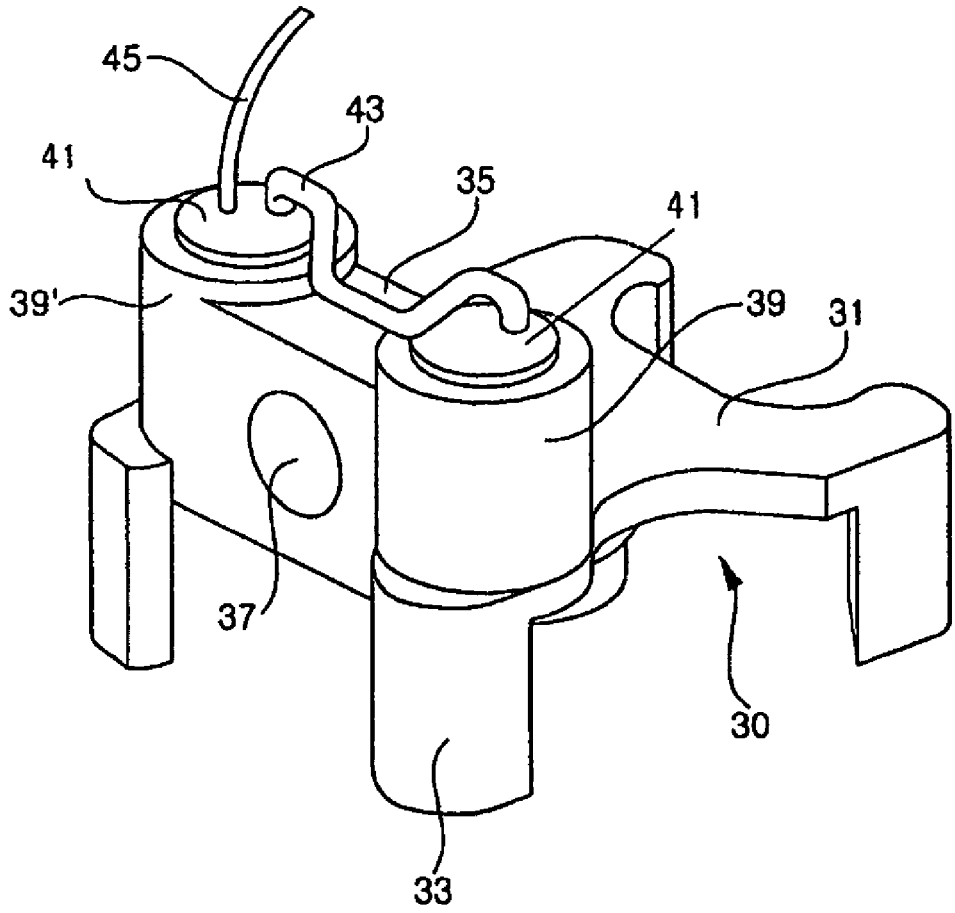
FIG. 3 is a perspective view showing a preferred embodiment of a discharging noise system of a hermetic compressor according to the present invention.

30: Frame
35: Cylinder block
37: Compressing chamber
39 and 39': Discharging noise suppressor
41: Noise suppressor cap
43: Connection pipe
45: Discharging pipe

BEST MODE

Hereinafter, preferred embodiments of a discharging noise system of a hermetic compressor according to the present invention will be explained in detail with reference to the accompanying drawings.

FIGS. 3 to 7 show various embodiments of a discharging noise system of a hermetic compressor according to the present invention.

As shown in the figures, a body 31 of a frame 30 is provided with connection legs 33, and the connection legs 33 are connected by a motor (not shown) provided in the hermetic container. The body 31 is provided with various parts for a compressor. The body 31 is provided with a cylinder block 35. The cylinder block 35 is to compress a work fluid, and a compressing chamber 37 is formed to be bored through the cylinder block 35 in a fore and aft direction.

The work fluid is introduced into the compressing chamber 37, and a piston (not shown) is provided in the compressing chamber 37. The piston serves to compress the work fluid introduced into the compressing chamber 37 while reciprocating in the compressing chamber 37.

A valve assembly (not shown) is installed together with a head cover (not shown) to the cylinder block 35 that corresponds to a front end of the compressing chamber 37, wherein a discharging chamber (not shown) is provided between the head cover and the valve assembly such that the work fluid compressed by the piston is temporarily collected in the discharging chamber. In addition, the work fluid collected in the discharging chamber is moved to discharging noise suppressors 39 and 39', which will be described later.

The first and second discharging noise suppressors 39 and 39' are provided at both sides of the cylinder block 35. The discharging noise suppressors 39 and 39' are to reduce noise and pulsation of the work fluid compressed in the compressing chamber 37. A noise chamber (not shown) is formed in each of the discharging noise suppressors 39 and 39'. The work fluid compressed in the compressing chamber 37 and temporarily collected in the discharging chamber stays in the noise chamber for a while, so that noise and pulsation is reduced. The work fluid introduced into the first discharging noise suppressor 39 is introduced into the second discharging noise suppressor 39' through a connection pipe 43, which will be described later.

Noise suppressor caps 41 are respectively installed to upper ends of the discharging noise suppressors 39 and 39'. The noise suppressor cap 41 serves to isolate the noise chamber provided in each of the discharging noise suppressor 39 and 39' from the outside. The connection pipe 43 is provided for allowing the discharging noise suppressors 39 and 39' to communicate with each other through the noise suppressor caps 41.

The connection pipe 43 allows the discharging noise suppressors 39 and 39' to communicate with each other, and the work fluid introduced into the first discharging noise suppressor 39 is transferred to the second discharging noise suppressor 39' through the connection pipe 43.

Figure 7:
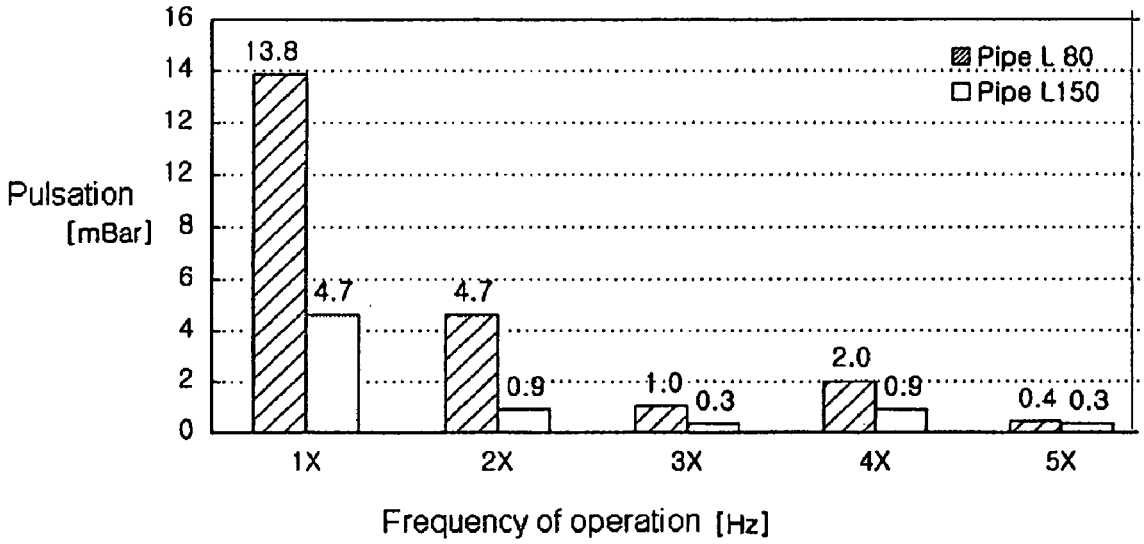
FIG. 7 is a graph showing the relationship between pulsation and length of a connection pipe of the discharging noise system of a hermetic compressor according to the present invention.

A characteristic of the pulsation generated in the connection pipe 43 is well shown in FIG. 7. The pulsation generated in the connection pipe 43 is shown on a vertical axis in the unit of mBar, and an operating frequency of the piston that causes pulsation is shown on a horizontal axis. As shown in the figure, it would be understood that the pulsation generated in the connection pipe 43 is smaller at the same operating frequency as the length of the connection pipe 43 is longer.

Figure 4:
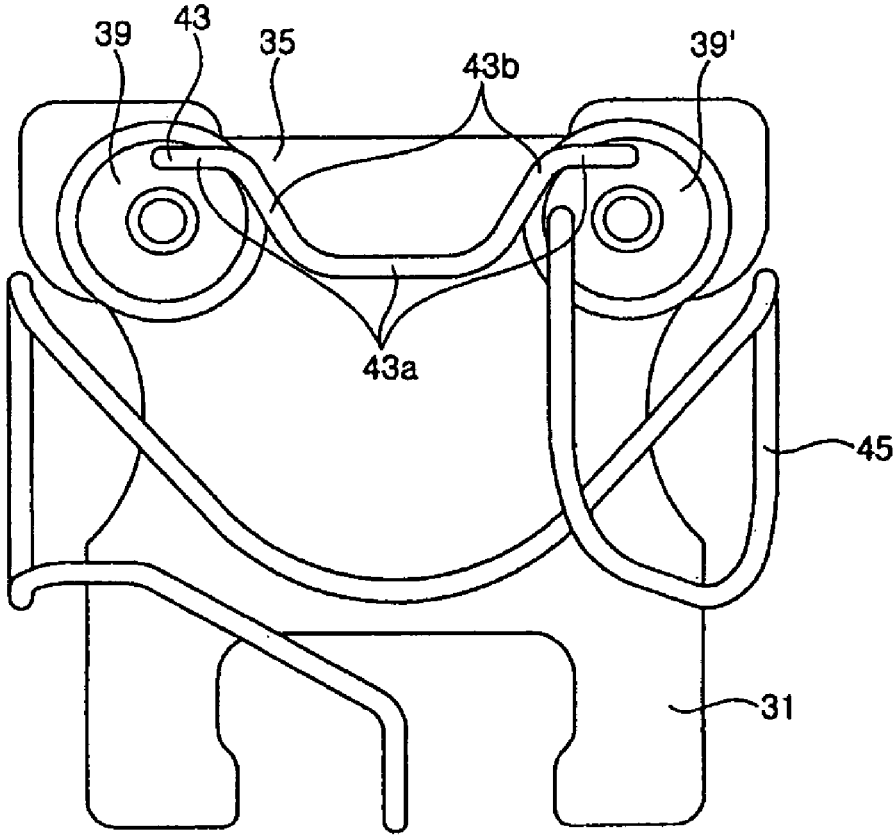
FIGS. 4 to 6 are plan views showing various embodiments of the discharging noise system of a hermetic compressor according to the present invention.
Figure 5:
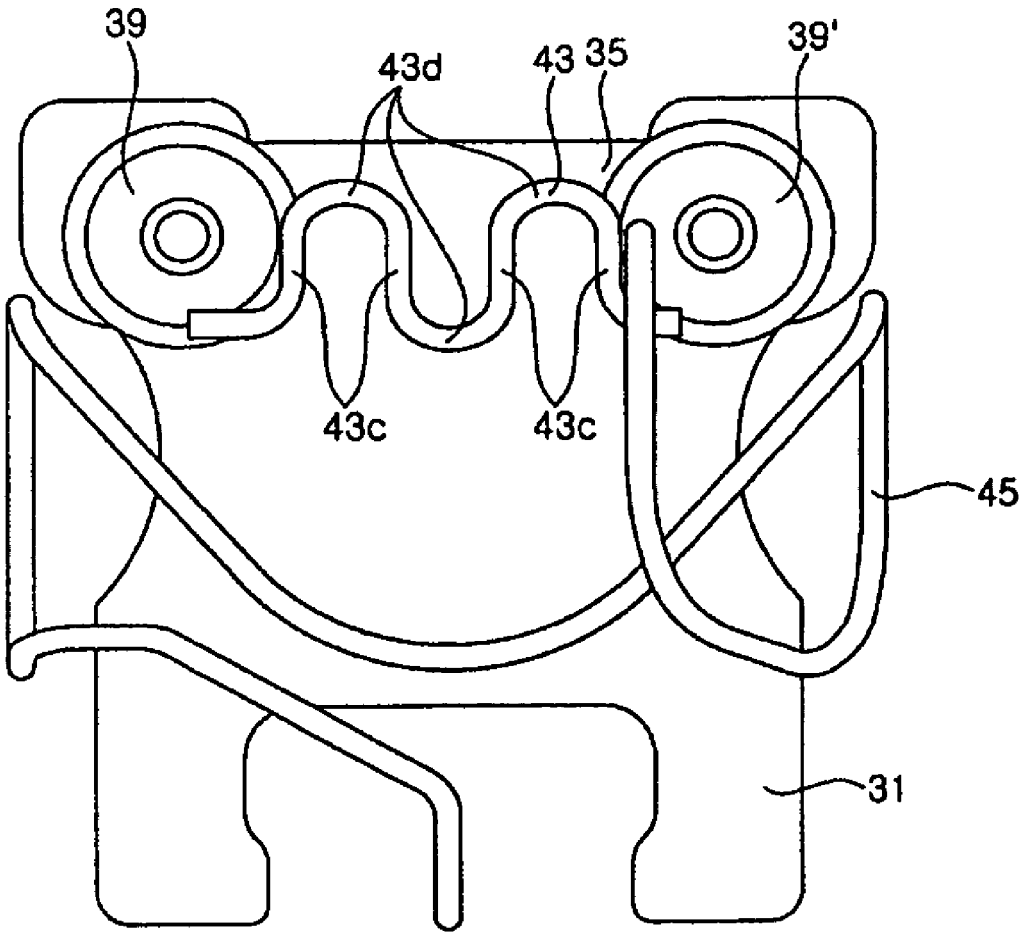
Figure 6:
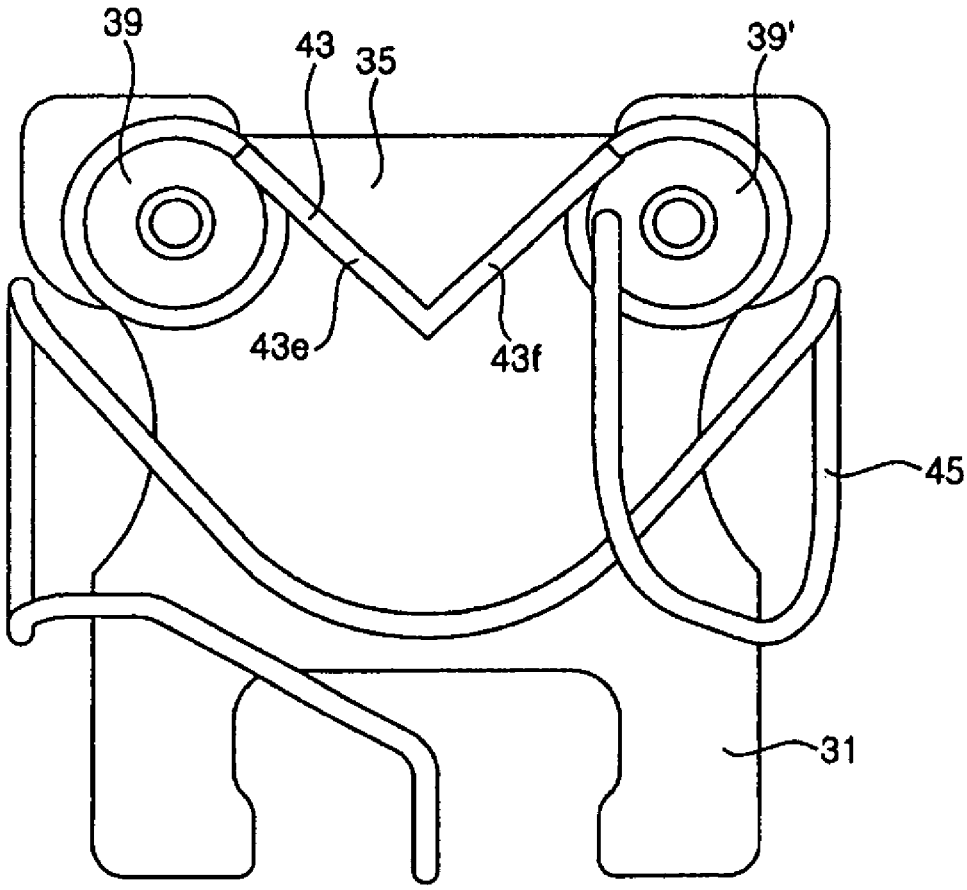

Pulsation is reduced as the length of the connection pipe 43 is longer due to the following reason. In a case where the connection pipe 43 is formed corresponding to the shortest straight distance between the discharging noise suppressors 39 and 39', the vibration generated from the pulsation is directly transferred to the connection points between the connection pipe 43 and the discharging noise suppressors 39 and 39', so that the connection points are weak against fatigue failure. However, in a case where the connection pipe 43 is formed to be bent as shown in FIGS. 4 to 6 at a predetermined position(s), the vibration generated from the pulsation is offset due to the elasticity of the bent portion of the connection pipe 43, which is more advantageous against fatigue failure. In addition, as the work fluid discharged from the compressing chamber 37 passes through the long connection pipe 43, the pulsation is reduced. Thus, as the connection pipe 43 is longer, pulsation is reduced.

Thus, it is preferred that the connection pipe 43 is formed relatively longer than the shortest straight distance between the discharging noise suppressors 39 and 39'. As shown in FIGS. 4 to 6, the connection pipe 43 is preferably bent at least once at a predetermined point, and also preferably formed 1.1 to 1.5 times as long as the shortest straight distance between the discharging noise suppressors 39 and 39'.

The connection pipe 43 may include linear portions 43*a* and inclined portions 43*b*, as shown in FIG. 4. One of the linear portions 43*a* formed horizontally with the straight distance between the discharging noise suppressors 39 and 39' has one end connected to the first discharging noise suppressor 39, and the other end connected to one end of one of the inclined portions 43*b* formed slantingly with respect to the straight distance between the discharging noise suppressors 39 and 39'. The other end of the inclined portion 43*b* is connected to one end of another one of the linear portions 43*a*. The other inclined portion 43*b* formed to be slanted reversely with respect to the inclined portion 43*b* connected to the first discharging noise suppressor 39 has one end connected to the other end of the linear portion 43*a*, and the other end connected to the other one of the linear portions 43*a*, and then the linear portion 43*a* is connected to the second discharging noise suppressor 39'.

In addition, the connection pipe 43 may include linear portions 43*c* and bent portions 43*d*, as shown in FIG. 5. The first discharging noise suppressor 39 is connected to one end of one of the linear portions 43*c* formed vertically with respect to the straight distance between the discharging noise suppressors 39 and 39', and the bent portions 43*d* interconnecting the linear portions 43*c* are connected to the other end of the linear portion 43*c*. The linear portions 43*c* and the bent portions 43*d* are alternately connected to each other and then connected to the second discharging noise suppressor 39'.

A discharging pipe 45, through which the work fluid introduced from the first discharging noise suppressor 39 is discharged to the outside, is provided at one side of the second discharging noise suppressor 39'. The work fluid moving through the discharging pipe 45 is discharged to the outside of the compressor.

Hereinafter, operation of the discharging noise system of a hermetic compressor according to the present invention configured as mentioned above will be explained in detail.

The piston reciprocates in the compressing chamber 37 provided in the cylinder block 35 to compress a work fluid. The work fluid compressed by the piston is introduced into the discharging chamber communicating with the compressing chamber 37, and the work fluid introduced into the discharging chamber is again introduced to the first discharging noise suppressor 39. The work fluid compressed by the piston is periodically discharged to the outside of the compressing chamber 37 by the linear reciprocation of the piston, so that the flow of the work fluid is periodically intercepted. Such a flow characteristic of the work fluid causes pulsation in the hermetic compressor.

The pulsation generated in the cylinder block 35 vibrates the connection pipe 43 that connects the first and second discharging noise suppressors 39 and 39'. This vibration acts as repeated stress between the connection pipe 43 and the discharging noise suppressors 39 and 39', thereby causing fatigue failure. However, as shown in FIG. 7, the connection pipe 43 has a length longer than the shortest straight distance between the discharging noise suppressors 39 and 39', so that the pulsation is relatively reduced.

The work fluid compressed in the compressing chamber 37 is temporarily collected in the discharging chamber communicating with the compressing chamber 37, and the work fluid temporarily collected in the discharging chamber is introduced into the first discharging noise suppressor 39. If the work fluid is introduced into the first discharging noise suppressor 39, noise and pulsation are reduced due to the noise chamber in the first discharging noise suppressor 39. The work fluid periodically discharged from the compressing chamber 37 is temporarily collected in the noise chamber having a relatively wide inner space, thereby reducing the noise and pulsation. The work fluid with the noise and pulsation reduced by the first discharging noise suppressor 39 is introduced into the second discharging noise suppressor 39' along the connection pipe 43.

When the work fluid is introduced into the second discharging noise suppressor 39', the noise and pulsation are also reduced by means of the noise chamber provided therein. Thus, if the work fluid passes through the discharging noise suppressors 39 and 39', the noise and pulsation are reduced twice. The work fluid passing through the second discharging noise suppressor 39' is discharged to the outside through the discharging pipe 45.

It will be apparent that those skilled in the art can make various modifications thereto within the scope of the fundamental technical spirit of the present invention. The true scope of the present invention should be interpreted on the basis of the appended claims.

INDUSTRIAL APPLICABILITY

The present invention is used for reducing noise and vibration of a hermetic compressor.

The invention claimed is:

1. A discharging noise system of a hermetic compressor which has a compressing chamber configured to be bored through a cylinder block for compressing work fluid introduced thereto, comprising:

a first discharging noise suppressor provided at one side of a cylinder block to firstly reduce noise and pulsation of work fluid introduced from the compressing chamber;

a second discharging noise suppressor provided at the other side of the cylinder block and communicating with the first discharging noise suppressor, the work fluid with noise and pulsation reduced by the first discharging noise suppressor being introduced into the second discharging noise suppressor, whereby noise and pulsation of the work fluid is secondarily reduced;

a connection pipe for allowing the first and second discharging noise suppressors to communicate with each other to form a channel for allowing the work fluid to move, both ends of the connection pipe are connected with upper ends of the discharging noise suppressors respectively, the connection pipe having a length 1.1 to 1.5 times as long as a shortest straight distance between the two points at which the ends of the connection pipe are connected with the upper ends of the discharging noise suppressors; and a discharging pipe provided at the second discharging noise suppressor to form a channel for allowing the work fluid to be discharged to the outside.

2. The discharging noise system as claimed in claim 1, wherein the connection pipe includes a first inclined portion formed slantingly with respect to a straight distance between the first and second discharging noise suppressors, the first inclined portion having one end connected to the first discharging noise suppressor; and a second inclined portion formed to be slanted reversely with respect to the first inclined portion, the second inclined portion having one end connected to the first inclined portion and the other end connected to the second discharging noise suppressor.

* * * * *